US005149124A

United States Patent [19]

Wittmann et al.

[11] Patent Number: 5,149,124

[45] Date of Patent: Sep. 22, 1992

[54] FRONT JAW

[75] Inventors: Heinz Wittmann; Karl Stritzl, both of Vienna; Andreas Janisch, Oeyenhausen, all of Austria

[73] Assignee: TMC Corporation, Baar, Switzerland

[21] Appl. No.: 608,544

[22] Filed: Nov. 2, 1990

[30] Foreign Application Priority Data

Nov. 3, 1989 [AT] Austria ..... 2542/89

[51] Int. Cl.[5] ..... A63C 9/08

[52] U.S. Cl. ..... 280/633; 280/623; 280/625; 280/628; 280/634

[58] Field of Search ..... 280/623, 625, 626, 628, 280/629, 630, 631, 633, 634

[56] References Cited

U.S. PATENT DOCUMENTS 3,902,730 9/1975 Tschida et al. ..... 280/11.35 T
4,365,822 12/1982 Nitschko et al. ..... 280/625
4,449,730 5/1984 Oberleitner et al. ..... 280/625
4,902,031 2/1990 Bogner ..... 280/625
4,974,869 12/1990 Muhlberger et al. ..... 280/634

FOREIGN PATENT DOCUMENTS 279440 3/1970 Austria .
321170 12/1972 Austria .
10311832 9/1988 European Pat. Off. .
2586580 9/1985 France .

*Primary Examiner*—Eric D. Culbreth
*Attorney, Agent, or Firm*—Flynn, Thiel, Boutell & Tanis

[57] ABSTRACT

A front jaw having a housing in which is housed a release spring and through which extends a pull rod acting through an opening in a crosspart onto two toggle levers holding the front end of the sole of the boot. The housing has at its rear end two vertical contact surfaces for a bearing part having a pair of axles thereon for pivotally supporting the two toggle levers. The two toggle levers include structure functioning as a sole down-holding device.

8 Claims, 3 Drawing Sheets

FRONT JAW

FIELD OF THE INVENTION

The invention relates to a front jaw having a vertically adjustable sole down-holding means and structure for allowing the sole down-holding means to pivot upwardly in response to a backward twisting fall.

BACKGROUND OF THE INVENTION

Such a front jaw is already described in the EP-A1 0 311 832 (corresponds to U.S. Pat. No. 4,902,031). The release force of a sole holder half is increased due to the friction between the ski boot and the ski, which release force is further compounded in this front jaw in the case of a twisting fall, and even further when combined with a frontal fall, so that in this case the actual release force remains approximately constant.

The axis of the release spring or the pull rod extends in this embodiment (see FIGS. 3 to 5) at an acute angle with respect to the upper side of the ski. This, however, has the result that only one component of the force of the release spring acts parallel with respect to the upper side of the ski. It is only this component that is effective for holding the ski boot. However, it was earlier determined that in order to achieve the requisite holding force, a stronger spring must be used. Because of the inclined position of the pull rod also further structural parts of the front jaw are arranged inclined, thus making the manufacture and the design more difficult.

In another known front jaw according to AT-PS 321 170 (corresponds to U.S. Pat. No. 3,902,730), the two toggle levers grip only the laterally facing edges of the sole of the boot. Furthermore, the pull rod has at its rear end a cross-part which, in the skiing position of the front jaw, rests on the shorter lever arms of the two toggle levers. To hold the sole of the boot from above, an additional sole down-holding means is provided, which during a backward twisting fall of the skier can be pivoted upwardly about an axis supported in the housing. Because of the additional sole down-holding means, this front jaw is slightly complicated in its design.

According to a presently pending application Ser. No. 07/556 845, filed Jul. 23, 1990, assigned to the same assignee as in the present matter, a front jaw has already been suggested in which the two toggle levers are supported in a bearing part arranged at the rear end of a housing, which bearing part is pressed against the housing under the influence of a release spring. The ski boot in this design is held exclusively by the two toggle levers, and the bearing part can during a fall of the skier be pivoted upwardly in the longitudinal plane and furthermore in a transverse plane. However, this front jaw has an automatic adjustment of the two toggle levers to the thickness of the sole of the boot, which is caused by two inclined surfaces and the release spring. The initial tension of the release spring is thereby, even if to a limited degree, dependent on the thickness of the sole of the boot.

SUMMARY OF THE INVENTION

The purpose of the invention is to overcome the disadvantages of the known designs and to provide a front jaw which is relatively simple in its design and wherein the entire spring force is fully active as the holding force.

The invention is adapted for use on a front jaw comprising a housing adapted to be mounted on a ski, in which housing is housed a release spring and through which housing extends a pull rod loaded by the release spring, which pull rod acts through a crosspart onto a shorter lever arm of each of two toggle levers pivotal about vertical axles, a longer lever arm of each of the two toggle levers engaging the front edge surface of the sole of the ski boot. Due to the fact that two bearing surfaces on the housing for a bearing part extend symmetrically on opposite sides of the vertical, central longitudinal plane of the front jaw, a support of the bearing part on the housing is assured with surface contact in the skiing position of the front jaw. Furthermore, the two toggle levers are also pivoted during a pivoting of the bearing part so that during a backward fall of the skier within the elasticity range, a guiding for the ski boot is maintained. After exceeding the elasticity range, a rotation of the bearing part about the axis of the pull rod is also permitted, which results in a lifting of the releasing toggle lever and thus in an easier release of the ski boot.

The bearing part of the front jaw is secured in a particularly simple manner in elevational direction in the elastic range against pivoting about the axis of the pull rod.

The front jaw also includes structure which facilitates an exact adjustment of the height of the two toggle levers, which also has structure thereon functioning as a sole down-holding means.

Up to now, the adjustment of the two toggle levers of a front jaw to the thickness of the sole of the boot was carried out by two separate adjusting screws (compare AT-PS 279 440).

It also has already been suggested to adjust a fork-shaped sole down-holding means in its elevational position relative to the sole of the boot by means of an adjusting screw, which was screwed into an internally threaded hole in the web of a U-shaped bar (see FR-OS 2 586 580). The legs of the bar were, in the skiing position of the front jaw, held on the outer sides of a spring housing, however, they were released during a backward fall of the skier. Moreover, this front jaw belongs to an entirely different class than the one according to the invention.

The front jaw also has a feature which guarantees guiding of the bearing part in the vertical longitudinal center plane and to take along the bearing part during adjustment of the screw.

BRIEF DESCRIPTION OF THE DRAWINGS

The drawings illustrate one exemplary embodiment of a front jaw of the invention, in which.

DETAILED DESCRIPTION

Figure 1:
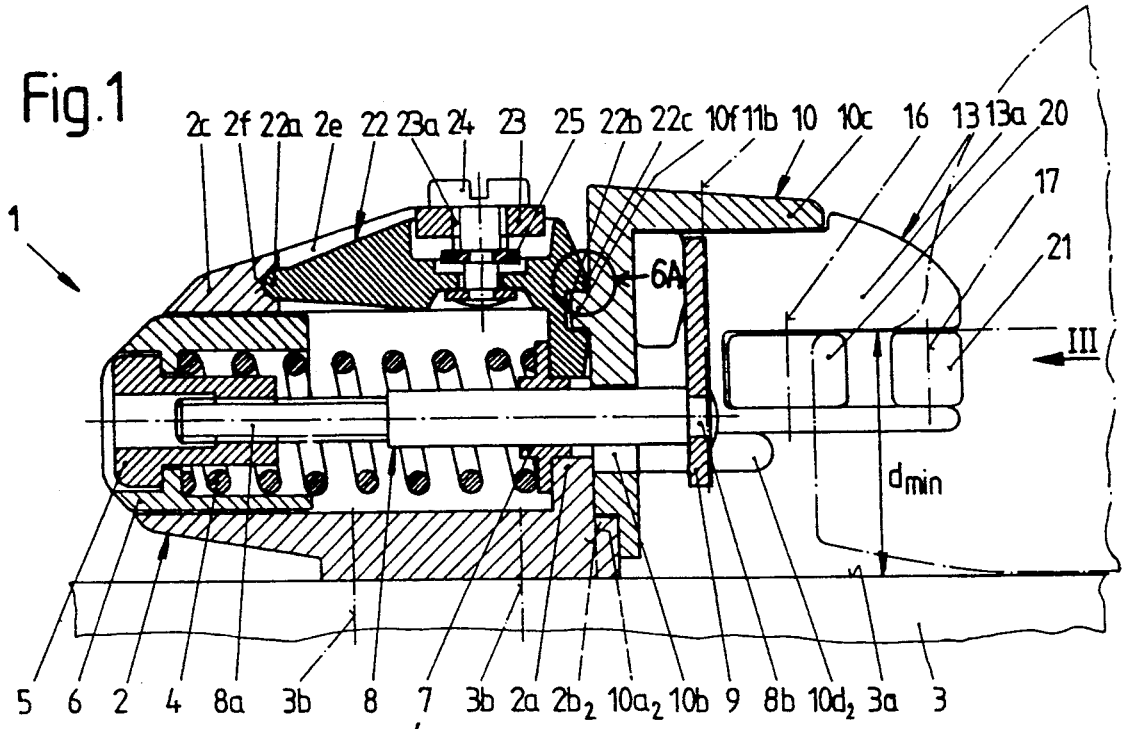
FIG. 1 is a vertical, central longitudinal cross-sectional view of the front jaw in the skiing position with a boot having a thin sole.

The front jaw in the drawings is identified in its entirety by the reference numeral 1. The front jaw 1 has a housing 2 which is fastened on the upper side 3*a* of a ski 3 by means of screws 3*b* (which are only schematically indicated). A release spring 4, designed as a helical spring, is housed in the housing 2. The release spring 4 is arranged between a spring plate 6 and a bearing sleeve 7 supported in a vertical crosswall 2*a* of the housing 2. A pull rod 8 extends in axial direction through the central part of the release spring 4. The threaded sleeve 5 is screwed onto one end 8*a* of the pull rod and the other end 8*b* of the pull rod is fastened, for example by riveting, to a crosspart 9. The initial tension of the spring 4 can be adjusted in a conventional manner by rotating the threaded sleeve 5.

Figure 4:
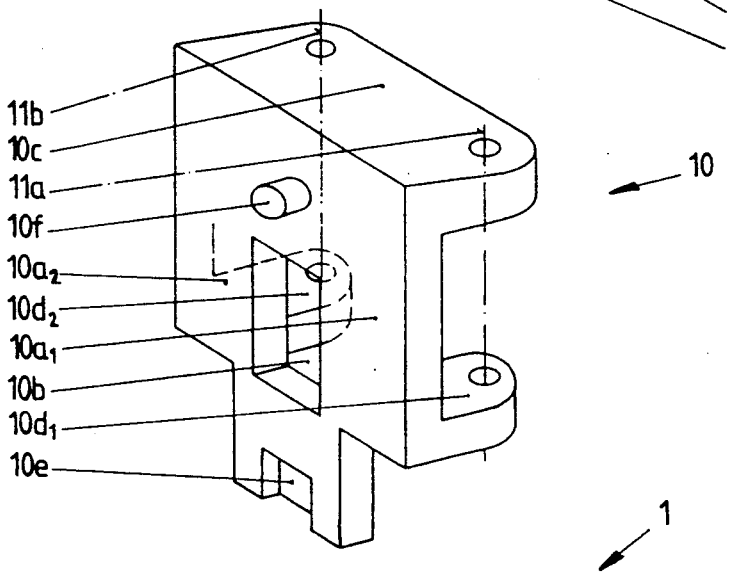
FIG. 4 is a perspective view of a detail of the front jaw.

Two laterally spaced apart, vertically extending contact surfaces $2b_1$ and $2b_2$ arranged symmetrically with respect to the vertical longitudinal center plane of the vertical crosswall 2*a* on the housing 2 at least in a region lying below the pull rod 8. A bearing part 10 rests with corresponding opposing surfaces $10a_1$ and $10a_2$ on the contact surfaces $2b_1$ and $2b_2$ in the skiing position of the front jaw 1. This bearing part 10 is, viewed from the rear, rectangular in shape and has a through opening 10*b* for the pull rod 8. It also has—viewed in the side view—approximately the shape of a C (compare FIG. 4). The upper leg of the C is formed by a plate 10*c* which is continuous in transverse direction, whereas the lower leg consists of two separate extensions $10d_1$ and $10d_2$ arranged symmetrically in relationship to the vertical longitudinal center plane. Vertically aligned holes receive axles 11*a* and 11*b*, which axles extend between the plate 10*c* and each of the extensions $10d_1$ and $10d_2$. A two arm toggle lever 12 is supported on the axle 11*a*, whereas a two arm toggle lever 13 is supported on the axle 11*b*. The longer lever arms 12*a*, 13*a* of each toggle lever 12, 13 have a substantially U-shaped cross section. Rollers 18–21 are rotatably mounted on axles 14–17, respectively, which extend between the two legs of the U-shaped lever arms. The upper legs of the longer lever arms 12*a*, 13*a* include a lip that overlaps the upper side of the sole of the boot to function as a sole down-holding means. The shorter lever arms 12*b*, 13*b* of the two toggle levers 12, 13 engage in a conventional manner the crosspart 9 fastened to the pull rod 8.

The crosswall 2*a* of the housing 2 has adjacent its lower edge a rearwardly directed horizontal projection 2*d* rectangular in the top view and extending in the skiing position of the front jaw 1 into a recess 10*e* on the bearing part 10.

Figure 2A:
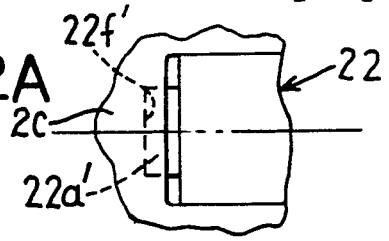
FIG. 2A is a top view of a fragment of FIG. 2 showing an alternate pivotal support for the lever.

The housing 2 has in its upper side a rectangular shaped opening 2*e* extending in a longitudinal direction of the front jaw, which opening opens toward the bearing part 10 and upwardly. A lever 22 is pivotally supported in the recess 2*e* and has a spherical trunnion 22*a* thereon which is received into a spherical recess 2*f* (or a cylindrical trunnion 22*a*' (FIG. 2A) which is received in a groove 2*f* having a semicircular cross section) arranged in a or a groove having a semicircular cross section, respectively, crosswall 2*c* defining one of the boundaries of the recess 2*e*. The lever 22 has a recess 22*b* in its free end remote from the trunnion, into which recess extends with clearance a cylindrical extension 10*f* of the bearing part 10. The contour of the recess 22*b* conforms to the contour of the extension 10*f*.

A transversely extending web 23, which is fastened to the housing 2, bridges the recess 2*e*. An internally threaded hole 23*a* is provided in the web 23, into which hole is screwed an adjusting screw 24. The lower end of the adjusting screw 24 is rotatable with respect to the lever 22, however, is secured to the lever 22 by means of a snap ring 25 so that axial movement of the screw 24 will cause a pivoting movement of the lever 22 about the trunnion 22*a*, 22*a*'.

Figure 5:
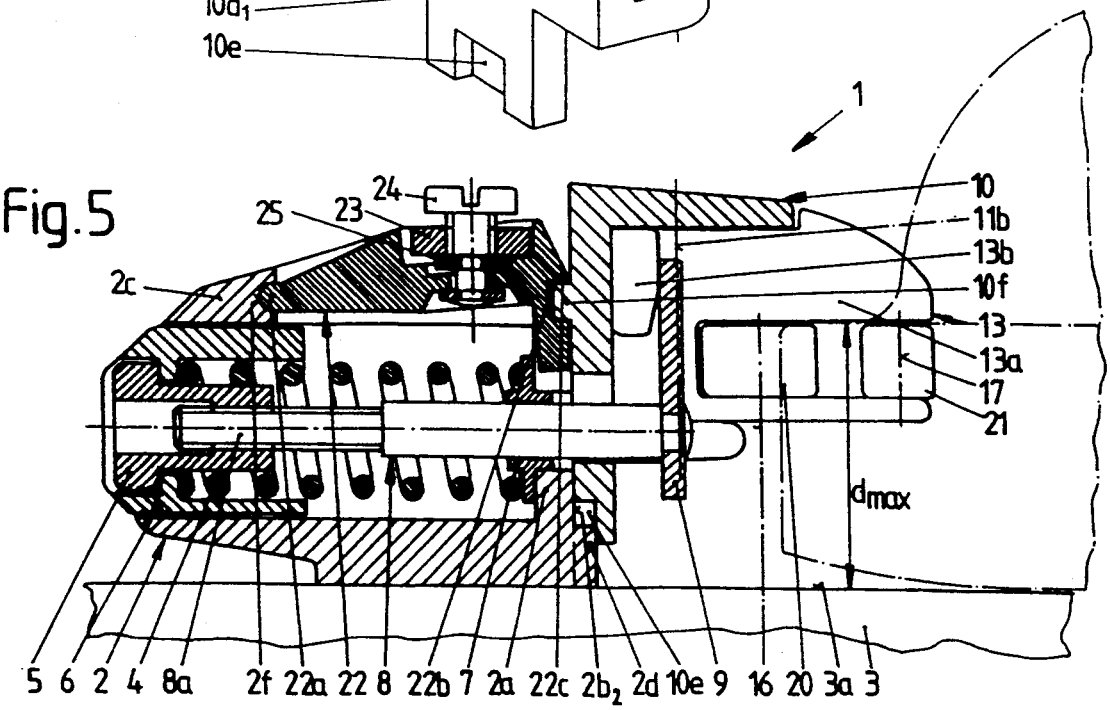
FIG. 5 is a vertical, central longitudinal cross-sectional view of the front jaw in the skiing position with a boot having a thick sole.

When the front jaw 1 is supposed to be adjusted to the thickness of the sole of the boot, then the adjusting screw 24 is first manually turned until the desired distance is adjusted. This distance is identified with $d_{min}$ in FIG. 1 and with $d_{max}$ in FIG. 5.

Figure 2:
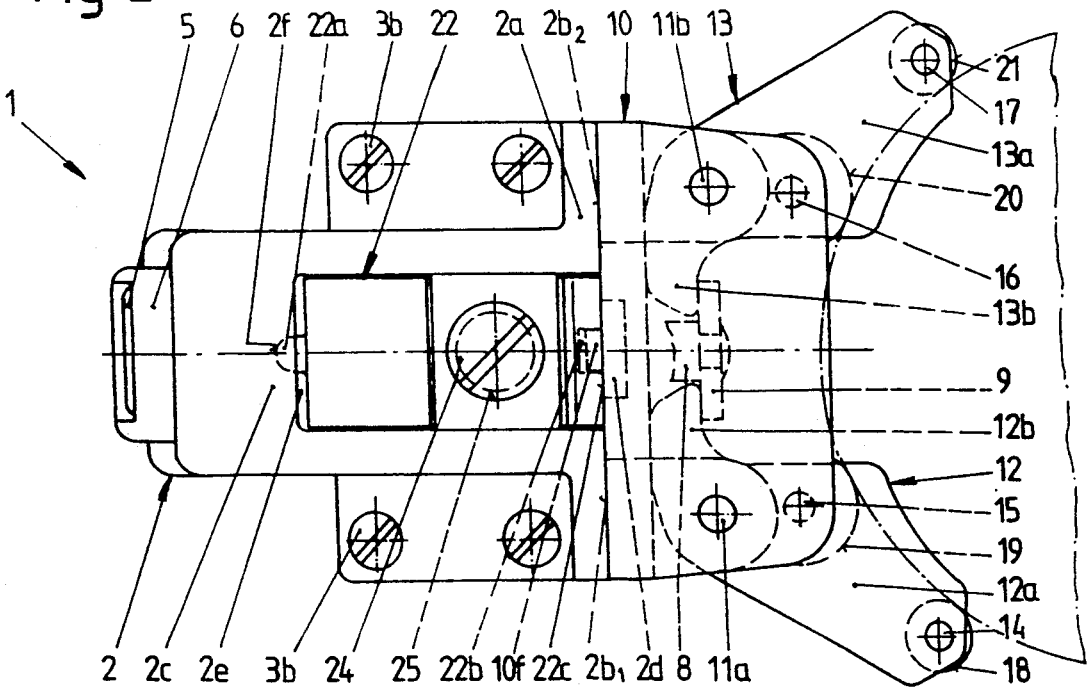
FIG. 2 is an associated top view.
Figure 3:
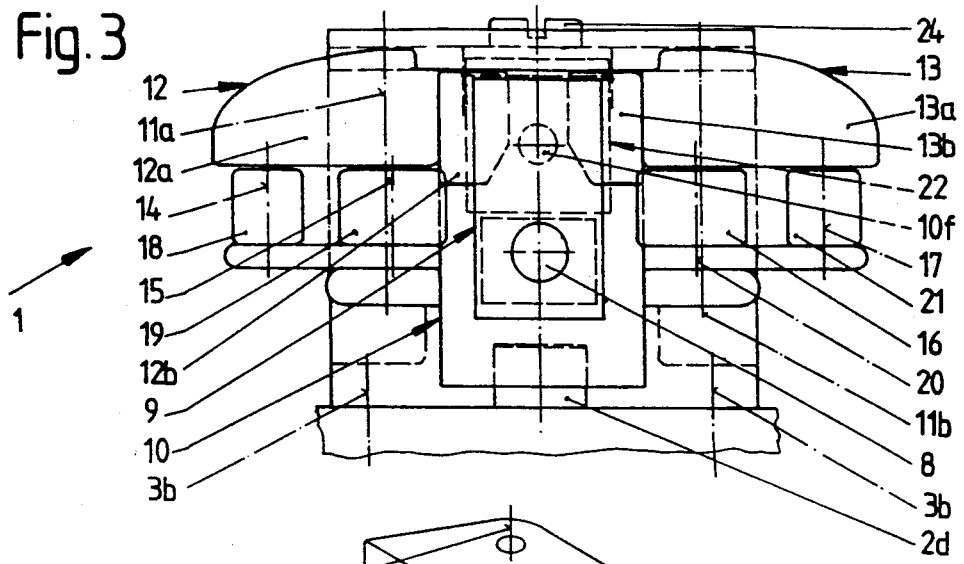
FIG. 3 is an associated view in direction of the arrow III in FIG. 1.

The individual parts assume in the skiing position the position illustrated in FIGS. 1 to 3.

Figure 6:
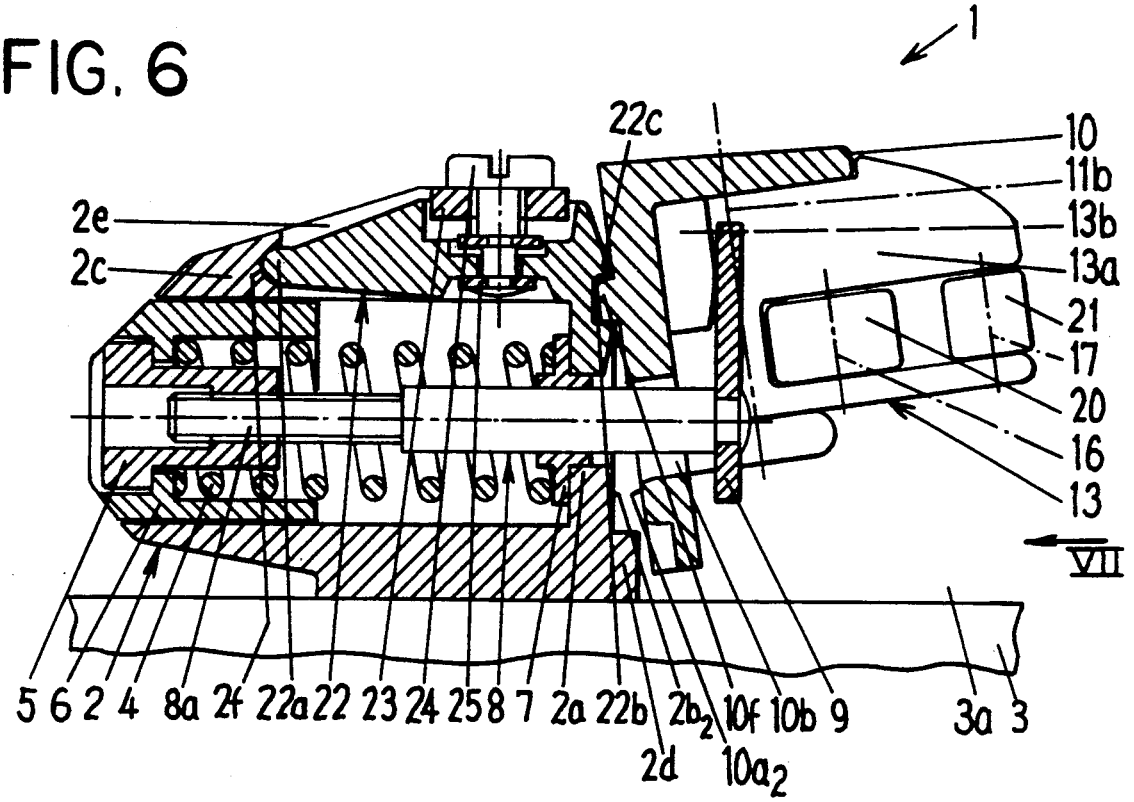
FIG. 6 is a vertical, central longitudinal cross-sectional view of the front jaw during a backward fall of the skier.
Figure 6A:
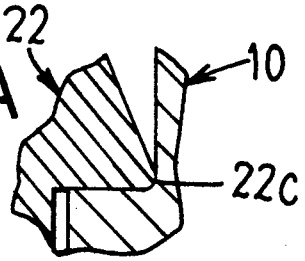
FIG. 6A is an enlarged illustration of the encircled portion 6A of FIG. 1.

If during skiing the skier falls backwards, then the bearing part 10 is pivoted upwardly about a rearwardly projecting rounded pivot edge 22*c* on the lever 22 to form a pivot axis thereat see FIGS. 6 and 6A. The release spring 4 is at the same time slightly compressed through the pull rod 8. Furthermore, the recess 10*e* in the bearing part 10 is lifted from the projection 2*d* on the housing 2. A pivoting of the bearing part 10 relative to the pull rod 8 is thus made possible. Due to the clearance between the extension 10*f* on the bearing part 10 and the recess 22*b* in the free end of the lever 22, there is no danger during a pivoting of the bearing part 10 in the vertical longitudinal center plane that the extension 10*f* of the bearing part 10 is thereby jammed, or that the lever 22 is damaged by the extension 10*f*.

Figure 7:
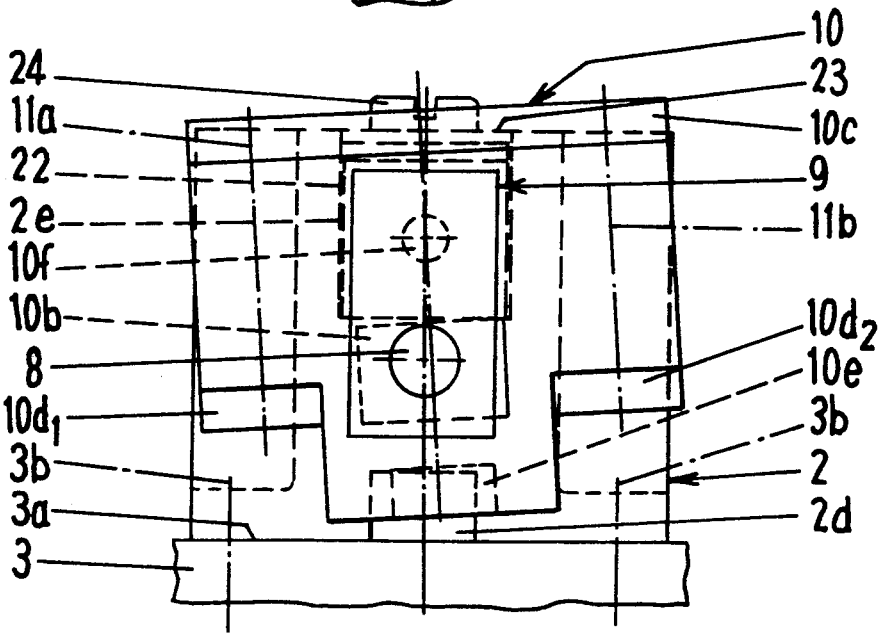
FIG. 7 is a view of the front jaw in direction of the arrow VII of FIG. 6, when the backward fall is combined with a twisting fall.

If the backward fall of the skier is combined with a twisting fall, then in addition to the pivoting of the bearing part 10 in the vertical longitudinal center plane, there occurs also a pivoting in a transverse plane as this is shown in FIG. 7. The extension 10*f* of the bearing part 10, which extension extends into the recess 22*b* of the lever 22, forms during this pivotal movement the pivot axis for the bearing part 10. This is possible because the through opening 10*b* in the bearing part 10 for the pull rod 8 is dimensioned generously and thus makes such a pivoting possible. The bearing part 10 is thereby slightly lifted on the side of the swung-out toggle lever, for example the lever 13, which makes the release of the ski boot easier.

The invention is not to be limited to the above-described exemplary embodiment illustrated in the drawings. Rather various modifications of the same are possible without departing from the scope of the invention. If in a simplified embodiment only the toggle levers are to be pivoted without causing the bearing part to be additionally pivoted in the transverse plane, then the trunnion can also have a square cross section. It would furthermore be conceivable to provide the lever carrying the adjusting screw with an extension extending with clearance into a recess on the bearing part. A further modification could be that in place of an adjusting screw, a threaded pin is fixedly anchored in the lever, which threaded pin carries a manually rotatable nut, for example a wing nut, with a compression spring being arranged between the web and the lever.

The embodiments of the invention in which an exclusive property or privilege is claimed are defined as follows:

1. In a front jaw comprising a housing adapted to be mounted on a ski, in which housing is housed a release spring and through which housing extends a pull rod loaded by the release spring, which pull rod acts through a crosspart onto a shorter lever arm of each of two toggle levers pivotal about vertically extending axles, a longer lever arm of each of the two toggle levers engaging a front edge surface of a sole of a ski boot, the housing having at its rear end two bearing surfaces extending symmetrically with respect to the vertical longitudinal center plane and with the two toggle levers simultaneously functioning as a sole down-holding means, the improvement wherein the axles of the two toggle levers are arranged in a bearing part having a through opening therethrough and through which opening the pull rod extends, the bearing part, when the toggle levers are in a position holding the ski boot onto the ski, being supported on the two bearing surfaces on the housing with means being provided for preventing a pivoting of the bearing part in a transversely extending plane toward the pull rod, and wherein the pull rod carries the crosspart at its rear end, which crosspart, when the toggle levers are in a position holding the ski boot onto the ski, rests on the shorter lever arms of the two toggle levers, and wherein adjustment means is provided for adjusting the elevation of the bearing part relative to the housing and, consequently, the elevation of the toggle levers to facilitate an accommodating of ski boots with varying sole thicknesses.

2. The front jaw according to claim 1, wherein the adjustment means includes the bearing part having below the through opening a recess for receiving a horizontal projection on a crosswall of the housing.

3. The front jaw according to claim 1, wherein the pull rod has a cylindrical cross section at its rear end area, which cylindrical cross section is guided in axial direction in a bearing sleeve fastened in a vertical crosswall of the housing.

4. The front jaw according to claim 1, wherein the adjustment means includes, in the region of the housing above the pull rod, a rectangularly shaped, rearwardly and upwardly opening recess, in which a one-arm lever is supported, which at its free end is coupled to the bearing part, and wherein the recess in the housing is bridged by a transversely extending, horizontal web having a vertically extending, internally threaded hole therethrough and in which is screwed an adjusting screw, the lower end of which screw is supported rotatably, however, secured against axial movement relative to the lever by means of a snap ring, whereby a rotating of the screw will cause the bearing part to be elevationally adjusted.

5. The front jaw according to claim 4, wherein a front end of the lever ends in a spherical trunnion resting in a spherical recess provided in a crosswall defining one of the walls of the recess.

6. The front jaw according to claim 4, wherein the front end of the lever has a cylindrical bulge extending in transverse direction, which bulge extends into a groove having a semicircular cross section, which groove is provided in a crosswall defining one of the walls of the recess.

7. The front jaw according to claim 4, wherein for coupling the bearing part to the lever, the bearing part has a cylindrical extension thereon extending toward the tip of the ski, which extension extends with clearance into a conformed recess in the lever, and wherein the bearing part is supported on the lever by a support surface.

8. The front jaw according to claim 7, wherein the support surface for the bearing part on the lever is formed by a rounded pivot edge.

* * * * *